United States Patent [19]

Sloan et al.

[11] 4,171,532

[45] Oct. 16, 1979

[54] THYRISTOR PULSE CONTROL CIRCUITS

[75] Inventors: Albert E. Sloan, Gateshead; Arthur Wild, Newcastle-upon-Lyne, both of England

[73] Assignee: Caterpillar Tractor Co., Peoria, Ill.

[21] Appl. No.: 909,246

[22] Filed: May 24, 1978

[51] Int. Cl.[2] ..... H01H 9/38

[52] U.S. Cl. ..... 361/13; 318/345 G; 361/109; 363/124

[58] Field of Search ..... 361/5, 7, 13, 109; 363/124; 318/345 R, 345 G

[56] References Cited

U.S. PATENT DOCUMENTS

| | | | |
|---|---|---|---|
| 3,430,063 | 2/1969 | Webb | 361/13 |
| 3,783,305 | 1/1974 | Lefferts | 361/13 |
| 4,054,817 | 10/1977 | Gurwicz et al. | 318/345 G X |
| 4,093,980 | 6/1978 | Gurwicz | 363/124 X |

*Primary Examiner*—Harry E. Moose, Jr.
*Attorney, Agent, or Firm*—John L. James

[57] ABSTRACT

A thyristor pulse control circuit has a main thyristor, a commutation circuit including a commutating capacitor, and a bypass contactor connected across the main thyristor, and is provided with apparatus for applying a gating signal to the main thyristor immediately before the contacts of the bypass contactor close and also immediately before the contacts of the bypass contactor close to prevent arcing at the contacts. The application of the gating signal is inhibited if a comparison of the voltage across the commutating capacitor with the load current flowing immediately before the bypass contactor closes indicates that the load current is too great to be safely commutated by the commutating capacitor at the measured voltage.

9 Claims, 1 Drawing Figure

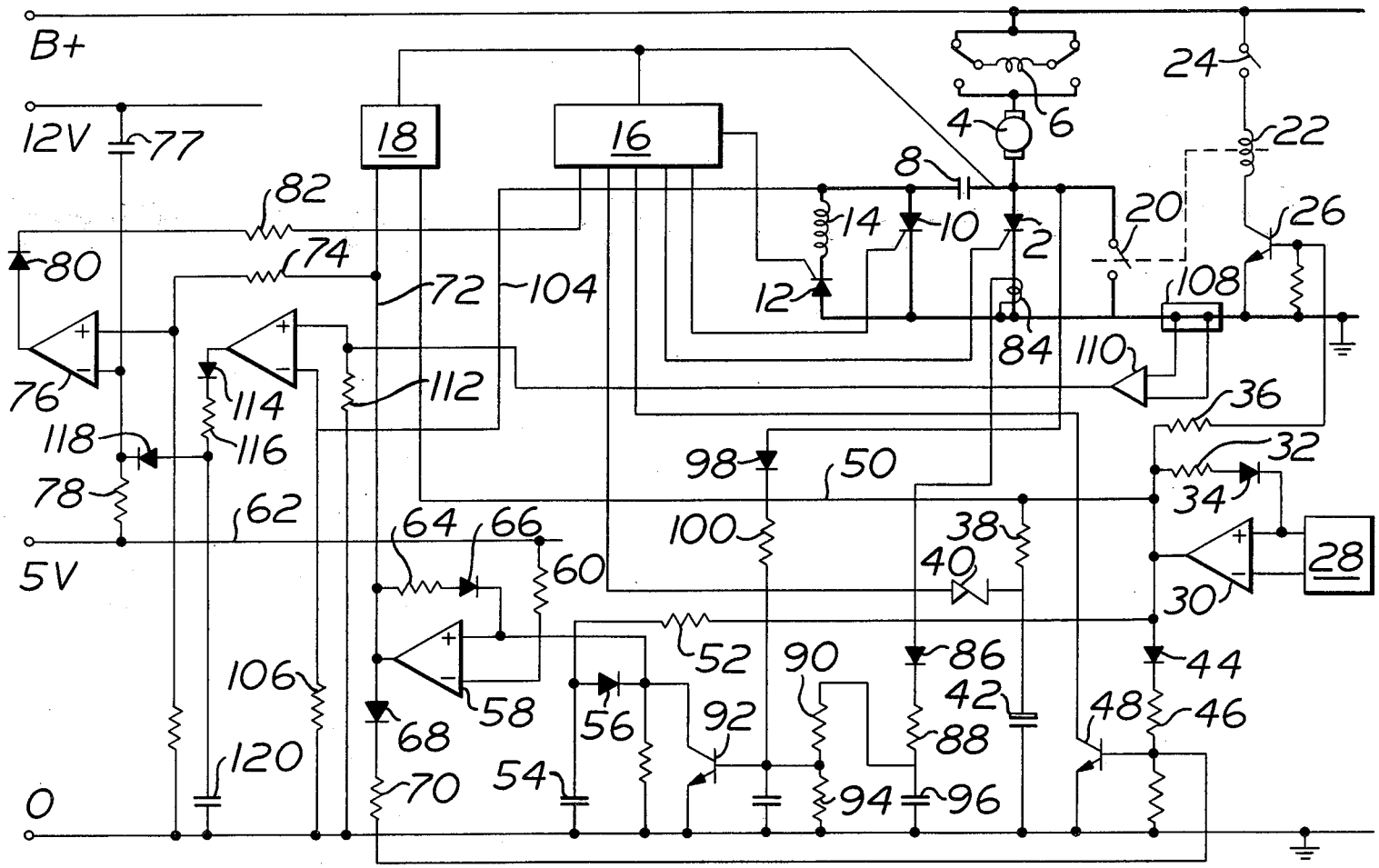
B+
12V
5V
0

THYRISTOR PULSE CONTROL CIRCUITS

BACKGROUND OF THE INVENTION

This invention relates to thyristor pulse control circuits.

More particularly, the invention relates to thyristor pulse control circuits of the kind comprising a main thyristor for connection between a load and a d.c. source, means for gating the thyristor into conduction, a commutation circuit including a commutating capacitor and means for charging the commutating capacitor and for connecting the charged capacitor across the main thyristor so as to reverse bias and thus commutate it, and a bypass contactor connected in parallel with the main thyristor so that on closure of the bypass contactor the load is connected direct to the d.c. source.

The bypass contactor enables the range of current which can be handled by the control circuit to be extended beyond that which would be economically feasible using the main thyristor alone. One of the problems associated with the operation of a bypass contactor is the arcing which occurs at the tips of the contactor when the tips open to break a high current; such arcing reduces the life of the contact or tips and so increases the maintenance required for the contactor. Arcing can also occur on closure of the contactor if the main thyristor is in a non-conducting state when the contactor tips make contact. One way of solving this problem, for example as described in United Kingdom Pat. No. 1,018,645, is to ensure that the main thyristor is gated immediately before contactor tips close and also immediately before the tips open, so that the main thyristor carries the load current at the instant the tips close or open and no arcing can occur. This is practicable since, although it is expensive to construct a thyristor chopper controller capable of continuous operation at very high currents, it is possible at relatively little expense to ensure that a controller can occasionally commutate very high currents. However, if the controller is to operate with a relatively low voltage source, for example if it is to control the d.c. traction motor of an industrial truck equipped with a 24 volt battery, the charge on the commutating capacitor may be insufficient to commutate the high current carried by the main thyristor after opening of the bypass contactor under high current conditions, unless the size of the capacitor is increased far beyond that required to commutate normal currents, thus increasing the cost of the controller. This problem also occurs if a long period of time elapses between closure and opening of the bypass contactor, during which time the charge of the commutating capacitor can be reduced by leakage to a low value.

SUMMARY OF THE INVENTION

This invention consists in a pulse control circuit of the kind set forth, in which there are provided circuit means for causing a gating signal to be applied to the main thyristor immediately before the contacts of the bypass contactor close and for causing a gating signal to be applied to the main thyristor immediately before the contacts of the bypass contactor open, and comparator means for comparing the voltage across the commutating capacitor with a voltage dependent on the magnitude of load current flowing immediately before the contacts of the bypass contactor open and operable to inhibit operation of the circuit means causing a gating signal to be applied to the main thyristor if the load current exceeds a value which can be safely commutated by the commutating capacitor at the measured voltage.

Since the main thyristor is not required to carry the current flowing through the bypass contactor if that current is too high to enable the thyristor to be commutated, the controller need not be provided with a commutating capacitor larger than is normally required. Although, when the load current is so high that the block pulse to the main thyristor is inhibited, arcing will occur as the contactor tips open, it is found in practice that the number of times this occurs is very low compared with the total number of operations of the bypass shorting contactor. For example, with a pulse controlled motor driving a fork lift truck, it is found that in the majority of cases the current being carried by the bypass contactor prior to opening is only marginally greater than, and often less than, the mean motor current prior to closure of the contactor. Conditions where this is not true are relatively unusual, for example if the bypass contactor is arranged to close at relatively low currents and the truck is driven up a steel ramp prior to the contactor being opened. Thus the invention enables arcing between the contactor tips to be prevented in the large majority of operations of the contactor, thus increasing the life of the tips, whilst obviating the need for a very large commutating capacitor and ensuring that commutation failure does not occur on opening of the contactor.

Preferably, the circuit means for causing a gating signal to be applied to the main thyristor is adapted to maintain the gating signal, unless inhibited by the comparator means, until current flow is established in the main thyristor after opening of the contactor tips. For example, a signal indicating the establishment of such current flow might be obtained from a current transformer sensing current flow in one of the leads to the main thyristor.

The voltage dependent on load current may be derived, for example, from a current shunt in series with load.

BRIEF DESCRIPTION OF THE DRAWING

The drawing is a schematic circuit diagram of a pulse control circuit constructed in accordance with the present invention.

DETAILED DESCRIPTION

Referring to the drawing, the pulse control circuit comprises a main thyristor 2, which is connected in series with the motor armature 4 and field windings 6 between the positive and negative terminals of a battery. A commutating capacitor 8 is connected in series with a commutating thyristor 10 across the main thyristor 2, and a reversal thyristor 12 and inductor 14 are connected across the commutating thyristor 10. Gating pulses are supplied to the thyristor 2, 10 and 12 from "on" and "off" oscillators in control circuitry 16. A fail-safe circuit 18 acts to disconnect the motor from the battery if the main thyristor 2 remains conducting for an excessive length of time. The construction and operation of the component parts of the pulse control circuit just described will be familiar to those skilled in the art and are therefore not described further.

A bypass contactor 20 is connected in parallel with the main thyristor 2. The actuating coil 22 of the bypass contactor is connected between the positive and negative terminals of the battery, through a foot switch 24 and an n-p-n transistor 26. The controller includes bypass selection circuitry 28, which, when the bypass contactor is to be closed, for example on closure of a switch connected to the accelerator pedal of a vehicle driven by the motor, supplies a signal to operational amplifier 30, causing a positive output from the amplifier, feedback via resistor 32 and diode 34 causing the amplifier to latch with its output high. Base drive is thus supplied via resistor 36 to transistor 26, switching on the transistor and energizing the bypass contactor actuating coil 22.

The output of amplifier 30 is also connected through a resistor 38 and zener diode 40 to the "on" oscillator in control circuitry 16, the junction of resistor 38 and zener diode 40 being connected through a capacitor 42 to battery negative. The high positive output of amplifier 30 is supplied to control circuitry 16 when the capacitor 42 has charged to the zener voltage of zener diode 40, the capacitor 42 thus introducing a delay between the occurrence of the output from amplifier 30 and the supply of a signal to circuitry 16. The signal thus supplied causes a block gating pulse to be supplied to the main thyristor 2. The output of amplifier 30 also provides base drive, through diode 44 and resistor 46 to switch on an n-p-n transistor 48, the collector of which is connected to the circuitry 16 so that operation of the "off" oscillator is inhibited when transistor 48 is switched on, to prevent gating pulses being supplied to the commutating thyristor 10. The delay provided by capacitor 42 ensures that the "off" oscillator is inhibited before the block gating pulse is supplied to main thyristor 2. The output of amplifier 30 is also supplied via line 50 to the fail-safe circuit 18 to inhibit the fail-safe circuit which would otherwise come into operation when the main thyristor 2 was held conducting by the block gating pulse.

The delay set by capacitor 42 before commencement of the block gating pulse to main thyristor 2 is less than the closing response time of the shorting contactor 20, so that the main thyristor 2 is gated into conduction before the contactor tips close. The voltage across the tips at the instant of closure is therefore low, about 1.2 volts, so that no arcing occurs.

The output of amplifier 30 is further connected through resistor 52 to one plate of a capacitor 54, the other plate of which is connected to battery negative. The junction of resistor 52 and capacitor 54 is connected through diode 56 to the non-inverting input of a differential amplifier 58, the inverting input of which is connected through resistor 60 to a 5-volt stabilized rail 62. Thus the high positive output of amplifier 30 charges capacitor 54 to a voltage above 5 volts and causes the output of differential amplifier 58 to go to a high value, feedback via resistor 64 and diode 66 causing the amplifier to latch in that state. The output of amplifier 58 is supplied through diode 68 and resistor 70 to the base of transistor 48, so that the output duplicates the action of amplifier 30 in switching on transistor 48 to inhibit the "off" oscillator of circuitry 16. The output of amplifier 58 is similarly supplied through line 72 to the fail-safe circuit to inhibit operation of that circuit, duplicating the function of amplifier 30.

The output of amplifier 58 is also connected through a resistor 74 to the non-inverting input of an amplifier 76, the inverting terminal of which is connected through resistor 78 to the 5-volt rail 62. A capacitor 77 is connected between a stabilized 12-volt rail and the inverting terminal of amplifier 76, to prevent the amplifier from producing a spurious output when the controller is first switched on. The output of amplifier 76, which is thus high when the output of amplifier 58 is high, is supplied through diode 80 and resistor 82 to the "on" oscillator of circuitry 16, to cause a block gating pulse to be applied to main thyristor 2.

The action of amplifier 58 thus duplicates that of amplifier 30; when the bypass selection circuitry supplies a signal to de-latch amplifier 30, to cause its output to go to zero so that the bypass contactor coil is de-energized, the output of amplifier 58 remains high in its latched state. Amplifier 58 therefore continues to inhibit the "off" oscillator and the fail-safe circuit 18 and to ensure the maintenance of the block gating pulse to main thyristor 2, to ensure that main thyristor 2 is gated when the bypass contactor tips open, unless the circuit is inhibited as described below.

A current transformer 84 is provided in the cathode path of main thyristor 2, the transformer generating an output pulse when load current is diverted to the main thyristor as the tips of bypass contactor 20 open. The transformer 84 is connected through diode 86 and resistors 88 and 90 to the base of an n-p-n transistor 92 the base of which is connected to battery negative through resistor 94 and the collector-emitter path of which is connected across capacitor 54 and diode 56. The junction of resistors 88 and 90 is connected to battery negative through a capacitor 96 which acts to lengthen the short pulse form transformer 84. The pulse from transformer 84 switches on transistor 92 so that the voltage at the noninverting input of amplifier 58 is pulled to zero and the output of the amplifier goes to zero. The signals inhibiting the "off" oscillator and the fail-safe circuit 18 are thus removed, and at the same time the output of amplifier 76 goes to zero so that the block gating pulse to main thyristor 2 is terminated. The controller then returns to normal operation.

A further base feed to transistor 92 is supplied from the junction of main thyristor 2 and bypass contactor 20, through diode 98 and resistor 100; this base feed is supplied when both the bypass contactor is open and the main thyristor 2 is non-conducting, and ensures that the controller returns to normal operation if the contactor tips open while main thyristor 2 is non-conducting, as described below.

A comparator 102 is provided to monitor the voltage across the commutating capacitor 8 and motor current. To this end, the junction of the commutating capacitor 8 and commutating thyristor 10 is connected through line 104 to the inverting input of the comparator, which is also connected to battery negative through a resistor 106. Motor current is measured by a shunt 108 in the lead to battery negative, the voltage developed across the shunt being amplified by amplifier 110 and supplied to the non-inverting input terminal of the comparator, which is also connected to battery negative through a resistor 112. The output of comparator 102 is connected through the series path of diode 114, resistor 116 and diode 118 to the inverting input of amplifier 76, the junction of resistor 116 and diode 118 being connected to battery negative through capacitor 120.

The comparator 102 and associated circuitry is arranged so that if the voltage on the commutating capacitor is less than that required to commutate the motor current, the voltage at the inverting input of the comparator falls below that at the non-inverting input, so that the output of the comparator goes to a high value.

The voltage at the inverting input of amplifier 76 thus goes high and its output goes to zero. Amplifier 76 is thus prevented from causing a block gating pulse to be supplied to main thyristor 2. Accordingly, on de-selection of the bypass contactor the block gating pulse is removed as soon as the output of amplifier 30 goes to zero, so that the main thyristor is not gated when the bypass contactor tips open. The load current is accordingly broken by opening of the contactor tips, following which transistor 92 is switched on as described above, and the pulse control circuit reverts to normal operation.

It has been found in use of the described circuit to control the traction motor of a fork lift truck, using a commutating capacitor of a size normally used on such a controller, that with a typical normal duty cycle for the truck the arc suppression circuit was operative to gate the main thyristor prior to opening of the contactor tips in more than 95% of contactor openings. This figure would of course vary with different duty cycles for the truck.

It will be apparent that many modifications could be made in the described emodiment. For example, various ways could be employed of deriving a voltage dependent on load current and of comparing that voltage with the voltage across the commutating capacitor. The current transformer 84 could be replaced by a current shunt.

Other aspects, objects and advantages will become apparent from a study of the drawings, disclosure and appended claims.

The embodiments of the invention in which an exclusive property or privilege is claimed defined as follows:

1. In a thyristor pulse control circuit having a main thyristor for connection between a load and a d.c. source, means for gating the thyristor into conduction, a commutation circuit including a commutating capacitor and means for charging the commutating capacitor and for connecting the charged capacitor across the main thyristor so as to reverse bias and thus commutate it, and a bypass contactor connected in parallel with the main thyristor so that on closure of the bypass contactor the load is connected direct to the d.c. source, the improvement comprising:

circuit means for causing a gating signal to be applied to the main thyristor immediately before the contacts of the bypass contactor close and for causing a gating signal to be applied to the main thyristor immediately before the contacts of the bypass contactor open; and comparator means for comparing the voltage across the commutating capacitor with a voltage dependent on the magnitude of load current flowing immediately before the contacts of the bypass contactor open and operable to inhibit operation of the circuit means causing a gating signal to be applied to the main thyristor when the load current exceeds a preselected value which can be safely commutated by the commutating capacitor at the measured voltage.

2. A pulse control circuit, as claimed in claim 1, wherein the circuit means maintains the gating signal, unless inhibited by the comparator means, until current flow is established in the main thyristor after opening of the contactor tips.

3. A pulse control circuit, as claimed in claim 2, including means for sensing the current flow through the main thyristor, supplying a signal to the circuit means and causing the gating signal to be removed and the control circuit to revert to normal operation when the said current flow exceeds a predetermined value.

4. A pulse control circuit, as claimed in claim 1, including a bypass contactor control means operable to energize an operating coil of the contactor when the contactor is to be closed and to de-energize the coil when the contactor is to be opened, and wherein the circuit means and bypass contactor control means are connected to the bypass contactor control means for initiating the gating signal when the bypass contactor control means is operated to energize the said operating coil and to terminate the said gating signal after the bypass contactor control means are operated to de-energize the said operating coil.

5. A pulse control circuit, as claimed in claim 4, wherein the circuit means for causing a gating signal to be applied to the main thyristor includes:

first circuit elements operable to generate a control signal causing the said gating signal to be applied, the control signal commencing when the bypass contactor control means operates to energize the contactor operating coil and terminating when the bypass contactor control means operates to de-energize the operating coil; and second circuit elements connected to the comparator means and operable to generate a further control signal causing the said gating signal to be applied, the further control signal commencing when the bypass contactor control means operates to energize the contactor operating coil and terminating when the comparator means indicates that the load current exceeds a value which can be safely commutated by the commutating capacitor at the measured voltage.

6. A pulse control circuit, as claimed in claim 4, wherein the control signal causing application of the gating signal is supplied after a delay less than the closing response time of the bypass contactor, and wherein the circuit means is operable to supply an additional signal before the end of the said delay to prevent operation of the said commutation circuit.

7. A pulse control circuit, as claimed in claim 1, wherein the comparator means compares the voltage across the commutating capacitor with a voltage proportional to the load current and prevents the application of the said gating signal to the thyristor when the latter voltage exceeds the former immediately before the contacts of the bypass contactor open.

8. A pulse control circuit, as claimed in claim 7, including a current shunt in the load circuit connected to the comparator to provide the said voltage proportional to load current.

9. A thyristor pulse control circuit comprising:

a main thyristor for connection between a load and a d.c. source;

means for gating the thyristor into conduction;

a commutation circuit having a commutating capacitor;

means for charging the commutating capacitor and connecting the charged capacitor across the main thyristor for reverse biasing and commutating the thyristor;

a bypass contactor connected in parallel with the main thyristor;

circuit means for appling a gating signal to the main thyristor immediately before the contacts of the bypass contactor close and appling a gating signal to the main thyristor immediately before the contacts of the bypass contactor open; and comparator means for comparing the voltage across the commutating capacitor with a voltage dependent on the magnitude of load current flowing immediately before the contacts of the bypass contactor open, inhibiting operation of the circuit means, and appling a gating signal to the main thyristor if the load current exceeds a preselected value which can be safely commutated by the commutating capacitor at the measured voltage.

* * * * *

UNITED STATES PATENT AND TRADEMARK OFFICE

CERTIFICATE OF CORRECTION

PATENT NO. : 4,171,532

DATED : October 16, 1979

INVENTOR(S) : Albert E. Sloan

It is certified that error appears in the above-identified patent and that said Letters Patent are hereby corrected as shown below:

On the Title Page, in the Abstract, Item [57], line 8, "close" should be --open--.

In Claim 9, Column 7, lines 1 and 3 and also in Column 8, line 3, "appling" should be --applying--.

Signed and Sealed this

*Nineteenth* Day of *February 1980*

[SEAL]

*Attest:*

SIDNEY A. DIAMOND

*Attesting Officer*

*Commissioner of Patents and Trademarks*